US012649619B2

(12) United States Patent
Brandeis et al.

(10) Patent No.: US 12,649,619 B2
(45) Date of Patent: Jun. 9, 2026

(54) PILL PACKET DISPENSER WITH CLAMSHELL CONTAINER SYSTEM

(71) Applicant: Ok Capsule, Inc., Reno, NV (US)

(72) Inventors: Andrew Brandeis, Worcester, VT (US); Noah Austin, Mill Valley, CA (US); Pepin Sebastian Gelardi, New York, NY (US); Jesse Klein, Brooklyn, NY (US); Henry Ripley, Brooklyn, NY (US)

(73) Assignee: Ok Capsule, Inc., Reno, NV (US)

( * ) Notice: Subject to any disclaimer, the term of this patent is extended or adjusted under 35 U.S.C. 154(b) by 261 days.

(21) Appl. No.: 18/629,217

(22) Filed: Apr. 8, 2024

(65) Prior Publication Data

US 2024/0383667 A1 Nov. 21, 2024

Related U.S. Application Data

(60) Provisional application No. 63/502,824, filed on May 17, 2023.

(51) Int. Cl.
*B65D 83/08* (2006.01)
*B65D 5/62* (2006.01)

(52) U.S. Cl.
CPC ..... *B65D 83/0805* (2013.01); *B65D 5/62* (2013.01)

(58) Field of Classification Search
CPC .. B65D 83/0805; B65D 5/62; B65D 83/0472; B65D 75/46; B65D 77/02; B65D 77/0413
See application file for complete search history.

(56) References Cited

U.S. PATENT DOCUMENTS

| | | | | |
|---|---|---|---|---|
| 4,676,446 | A | 6/1987 | Ciocarelli et al. | |
| 4,733,797 | A * | 3/1988 | Haber | A61J 7/0084 221/25 |
| 4,986,438 | A | 1/1991 | Borst | |
| 6,293,452 | B1 | 9/2001 | Mandar | |
| 6,971,522 | B2 | 12/2005 | Yuyama et al. | |
| 7,350,670 | B2 | 4/2008 | Steeves et al. | |
| 8,002,113 | B1 | 8/2011 | Cummings | |
| 8,608,024 | B2 * | 12/2013 | Giraud | B65D 83/0409 221/256 |
| 8,662,347 | B2 * | 3/2014 | Coggins | A61B 5/25 221/73 |
| 9,266,698 | B2 | 2/2016 | Sheehy et al. | |
| 10,273,037 | B2 | 4/2019 | Pan et al. | |
| 10,737,874 | B2 | 8/2020 | Pourian et al. | |
| 11,319,141 | B2 | 5/2022 | Trani et al. | |
| 2006/0163269 | A1 * | 7/2006 | Anderson | A61M 15/0045 221/72 |
| 2010/0252479 | A1 | 10/2010 | Corroon | |
| 2015/0298895 | A1 * | 10/2015 | Corbett | B65B 5/08 53/467 |
| 2017/0096286 | A1 * | 4/2017 | Pourian | B65D 83/0472 |
| 2021/0177703 | A1 * | 6/2021 | Tignanelli | G01R 33/091 |

FOREIGN PATENT DOCUMENTS

| | | | |
|---|---|---|---|
| AU | 2021104287 | A4 | 9/2021 |
| WO | 1999038776 | A1 | 8/1999 |

* cited by examiner

*Primary Examiner* — Michael Collins
(74) *Attorney, Agent, or Firm* — J. Peter Paredes; Amin Wasserman Gurnani LLP

(57) ABSTRACT

Provided herein are systems and methods for a Pill Packet Dispenser with a clamshell container.

7 Claims, 9 Drawing Sheets

PILL PACKET DISPENSER WITH CLAMSHELL CONTAINER SYSTEM

CROSS-REFERENCE TO RELATED APPLICATIONS

The present application claims priority for U.S. provisional application Ser. No. 63/502,824, filed May 17, 2023, herein incorporated by reference in its entirety.

BACKGROUND

The invention relates to the packaging and dispensing of a roll of packets containing vitamins, supplements, or pharmaceuticals.

Stuffing a round roll into a square box is labor intensive and does not dispense well for the consumer. The present invention attempts to solve these problems, as well as others.

SUMMARY OF THE INVENTION

Provided herein are systems and methods for a Pill Packet Dispenser with refillable clamshell container.

The methods and systems are set forth in part in the description which follows, and in part will be obvious from the description, or can be learned by practice of the methods and systems. The advantages of the methods and systems will be realized and attained by means of the elements and combinations particularly pointed out in the appended claims. It is to be understood that both the foregoing general description and the following detailed description are exemplary and explanatory only and are not restrictive of the methods and systems, as claimed.

Accordingly, it is an object of the invention not to encompass within the invention any previously known product, process of making the product, or method of using the product such that Applicants reserve the right and hereby disclose a disclaimer of any previously known product, process, or method. It is further noted that the invention does not intend to encompass within the scope of the invention any product, process, or making of the product or method of using the product, which does not meet the written description and enablement requirements of the USPTO (35 U.S.C. § 112, first paragraph) or the EPO (Article 83 of the EPC), such that Applicants reserve the right and hereby disclose a disclaimer of any previously described product, process of making the product, or method of using the product. It may be advantageous in the practice of the invention to be in compliance with Art. 53(c) EPC and Rule 28(b) and (c) EPC. All rights to explicitly disclaim any embodiments that are the subject of any granted patent(s) of applicant in the lineage of this application or in any other lineage or in any prior filed application of any third party is explicitly reserved. Nothing herein is to be construed as a promise.

BRIEF DESCRIPTION OF THE DRAWINGS

In the accompanying figures, like elements are identified by like reference numerals among the several preferred embodiments of the present invention.

DETAILED DESCRIPTION OF THE INVENTION

Figure 1A:
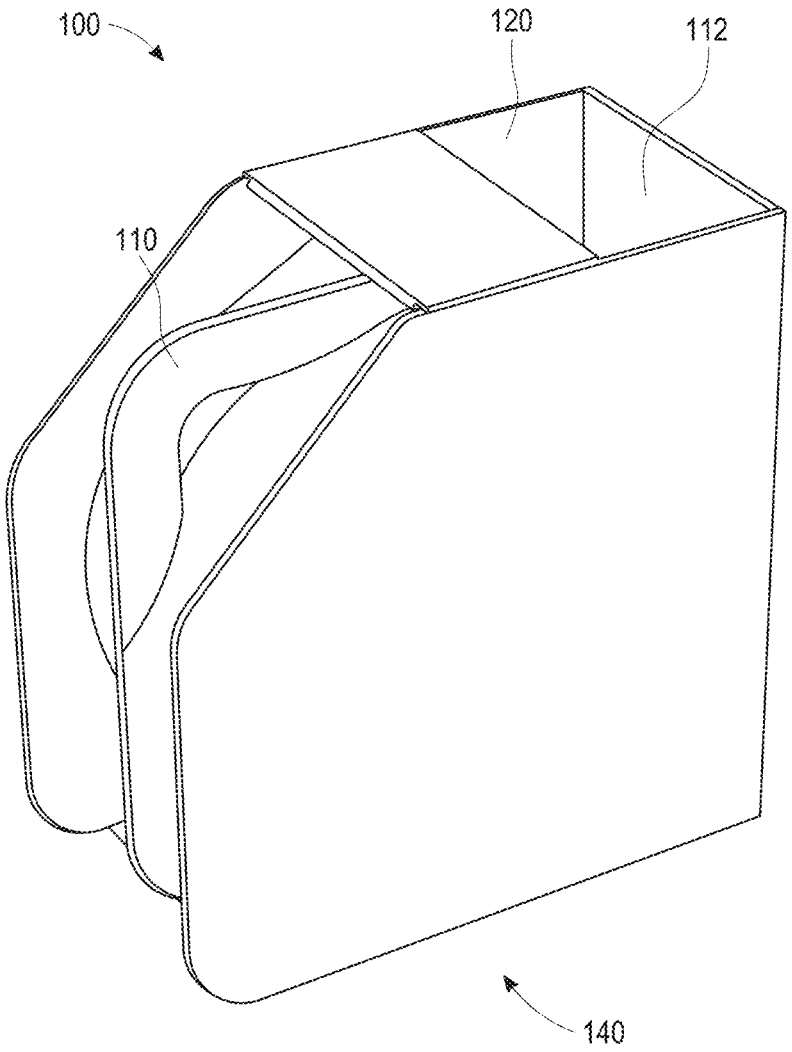
FIG. 1A is a front perspective view of the Pill Packet Dispenser with refillable clamshell container.

The foregoing and other features and advantages of the invention are apparent from the following detailed description of exemplary embodiments, read in conjunction with the accompanying drawings. The detailed description and drawings are merely illustrative of the invention rather than limiting, the scope of the invention being defined by the appended claims and equivalents thereof.

Embodiments of the invention will now be described with reference to the Figures, wherein like numerals reflect like elements throughout. The terminology used in the description presented herein is not intended to be interpreted in any limited or restrictive way, simply because it is being utilized in conjunction with detailed description of certain specific embodiments of the invention. Furthermore, embodiments of the invention may include several novel features, no single one of which is solely responsible for its desirable attributes or which is essential to practicing the invention described herein.

The use of the terms "a" and "an" and "the" and similar referents in the context of describing the invention are to be construed to cover both the singular and the plural, unless otherwise indicated herein or clearly contradicted by context. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

Recitation of ranges of values herein are merely intended to serve as a shorthand method of referring individually to each separate value falling within the range, unless otherwise indicated herein, and each separate value is incorporated into the specification as if it were individually recited herein. The word "about," when accompanying a numerical value, is to be construed as indicating a deviation of up to and inclusive of 10% from the stated numerical value. The use of any and all examples, or exemplary language ("e.g." or "such as") provided herein, is intended merely to better illuminate the invention and does not pose a limitation on the scope of the invention unless otherwise claimed. No language in the specification should be construed as indicating any nonclaimed element as essential to the practice of the invention.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

As used herein the term "method" refers to manners, means, techniques and procedures for accomplishing a given task including, but not limited to, those manners, means, techniques and procedures either known to, or readily developed from known manners, means, techniques and procedures by practitioners of the mechanical, biological, and physical arts. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

DESCRIPTION OF EMBODIMENTS

Figure 1B:
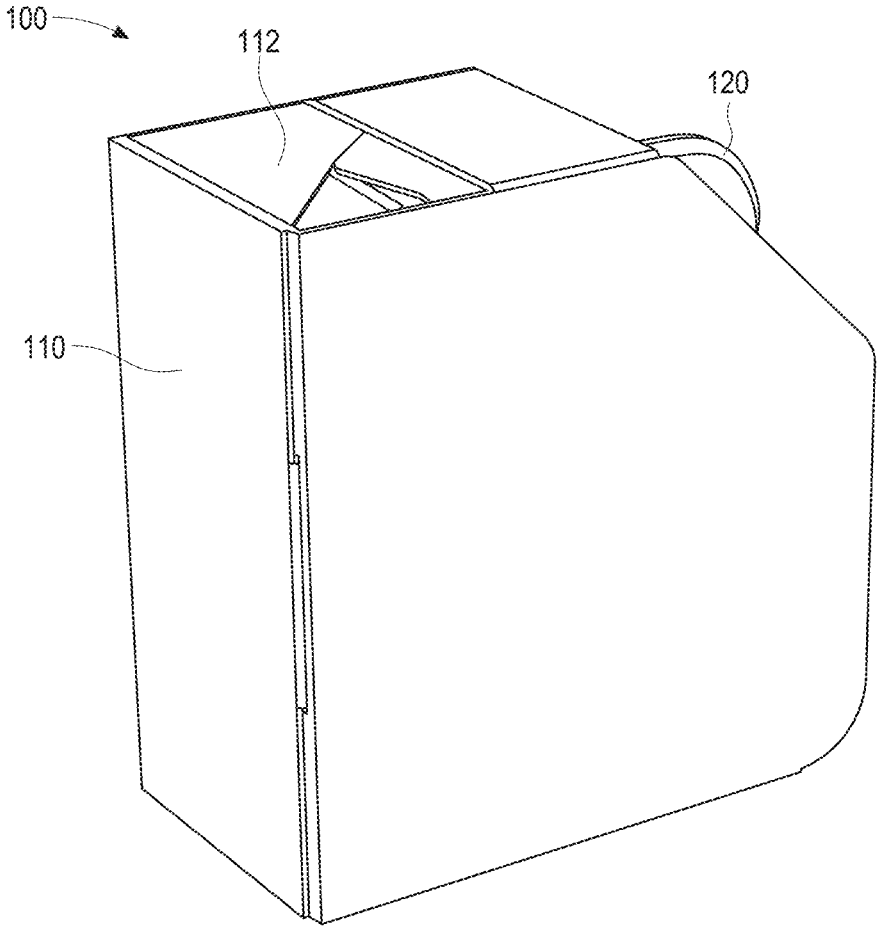
FIG. 1B is a back perspective view of the Pill Packet Dispenser with refillable clamshell container.

Generally speaking, the Pill Packet Dispenser with a clamshell container system 100 comprises an outer sleeve 110 and a clamshell container 120 contained with the outer sleeve 110, as shown in FIGS. 1A-1B. The Pill Packet Dispenser with a clamshell container system 100 is for packaging and dispensing of a roll of packets 200 containing vitamins, supplements or pharmaceuticals, as shown in in FIGS. 4A-4C. The Pill Packet Dispenser with a clamshell container system 100 is reusable, recyclable, refillable, interchangeable, dispenses well without the packets falling back into the clamshell container 120. The Pill Packet Dispenser with a clamshell container system 100 is easy to load, dispense, refill. As shown in FIGS. 1A-1B, the Pill Packet Dispenser with a clamshell container system dispenses a roll of packets through a top opening 112 of the outer sleeve 110.

Figure 2A:
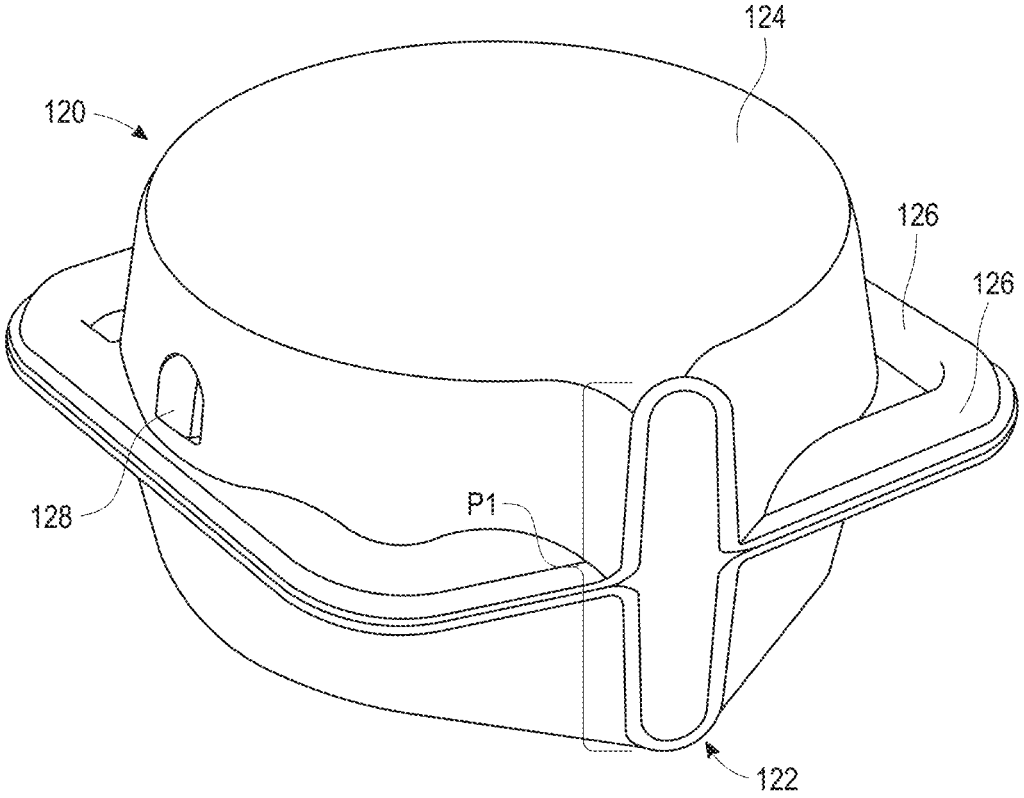
FIG. 2A is a front perspective view of the refillable clamshell container in the closed position.
Figure 2B:
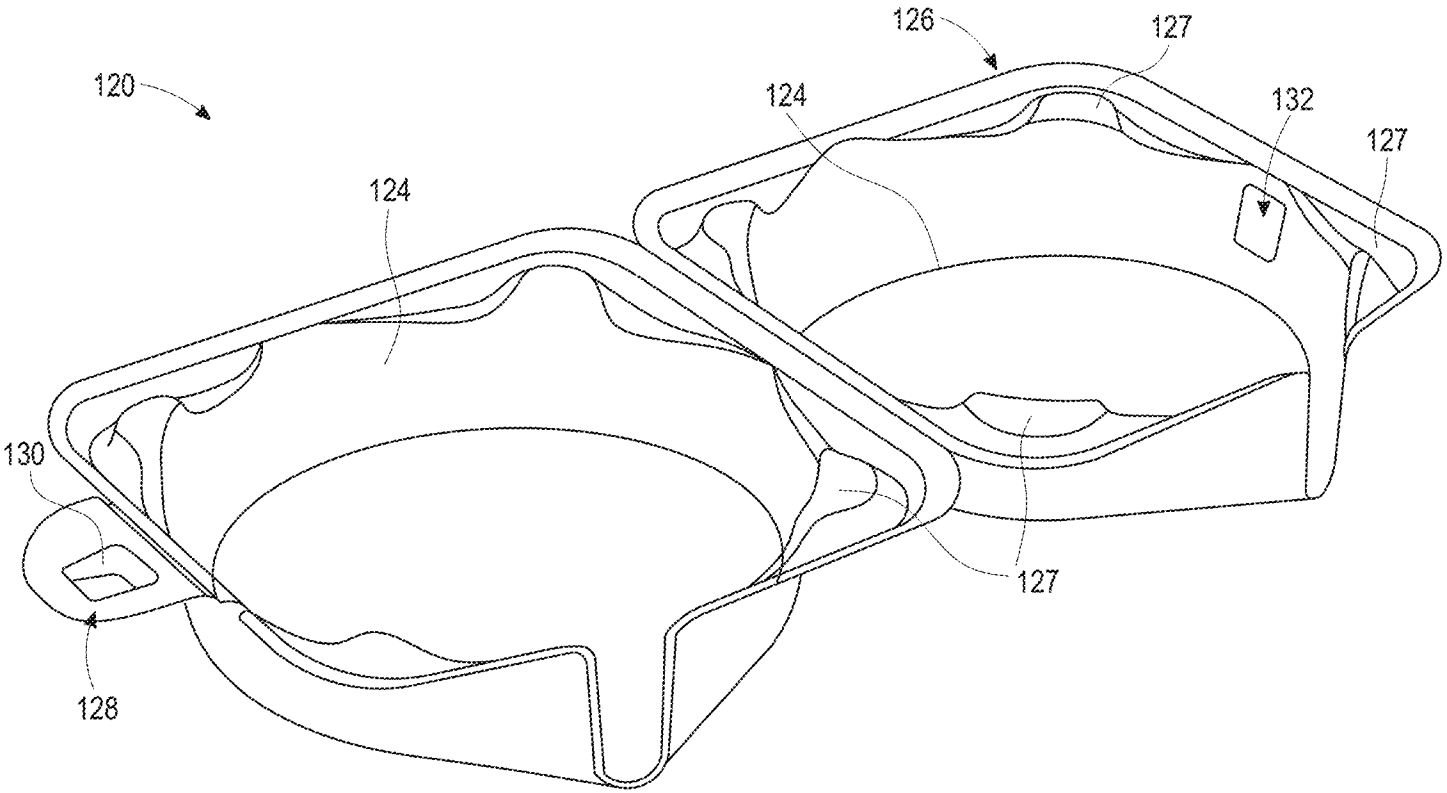
FIG. 2B is a front perspective view of the refillable clamshell container in the open position.
Figure 4C:
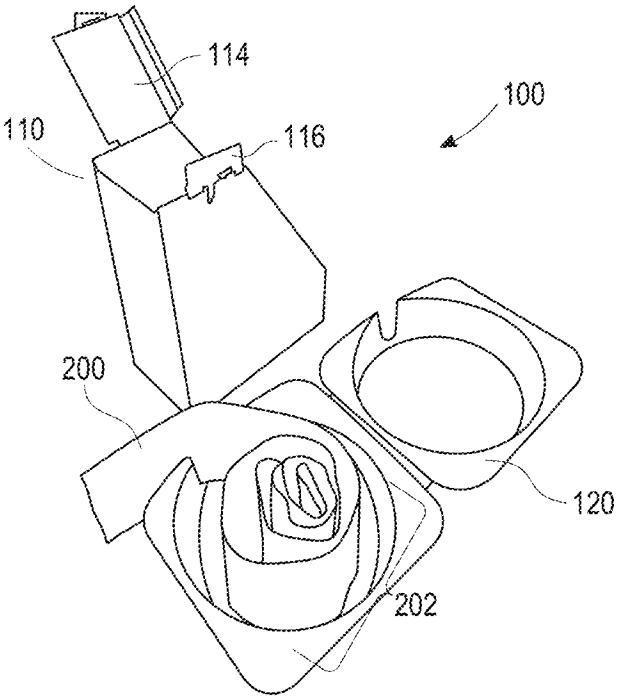
FIG. 4C is a front perspective view of the Pill Packet Dispenser with refillable clamshell container in the open position including a packet.

As shown in FIG. 2A, the clamshell container 120 is in the closed position and includes a slit opening 122 on the upper corner of the clamshell container 120. The slit opening 122 includes an oval-sized opening P1 to permit the packets to be dispensed through the clamshell container 120. The oval-sized opening P1 may be adjusted to the size and width of packets to permit dispensing. In one embodiment, the oval sized opening P1 includes a width between about 0.05 and about 0.50 inches, alternatively, between about 0.10 inches and 0.45 inches, alternatively, between about 0.15 inches and 0.40 inches, alternatively, between about 0.20 inches and 0.35 inches, alternatively, about 0.30 inches. The clamshell may be a single unitary cartridge piece or two cartridge pieces that close upon itself, such as two separate halves held together when inserted into the sleeve, according to one embodiment. The clamshell container 122 includes a central circular shell 124, a square border 126, and a locking feature 128. The central circular shell 124 allows the packets to be contained in a circular self-wrapping configuration 202, as shown in FIG. 4C. The square boarder 126 is sized to be contained with the outer sleeve 110. The locking feature 128 allows the clamshell container 120 to be locked in the closed position once the packets are loaded into the clamshell container 120. As shown in FIG. 2B, the clamshell container is in the open position, which allows the packets to be loaded in the central circular shell 124 and be refillable. The central circular shell 124 includes a volume V1 sufficient to contain the circular self-wrapping packet. The locking feature 128 includes a tabbed portion 130 and a tab opening 132, which operate to lock the clamshell container 120 once in the closed position. The square boarder 126 includes four engagement portion 127 that abut each other once the clamshell container 120 is in the closed position.

Figure 3B:
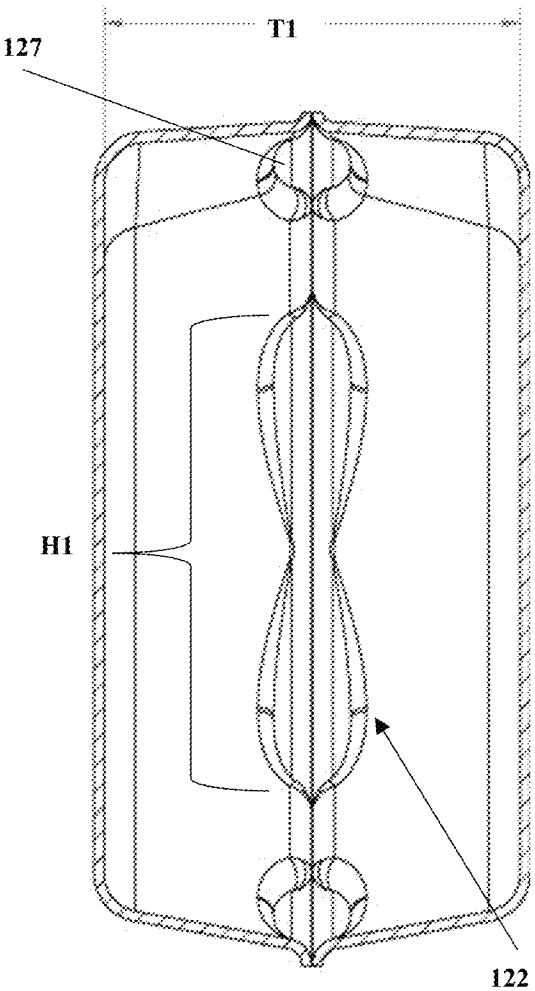
FIG. 3B is a side view of the refillable clamshell container taken along lines 3B-3B as shown in FIG. 3A.
Figure 3A:
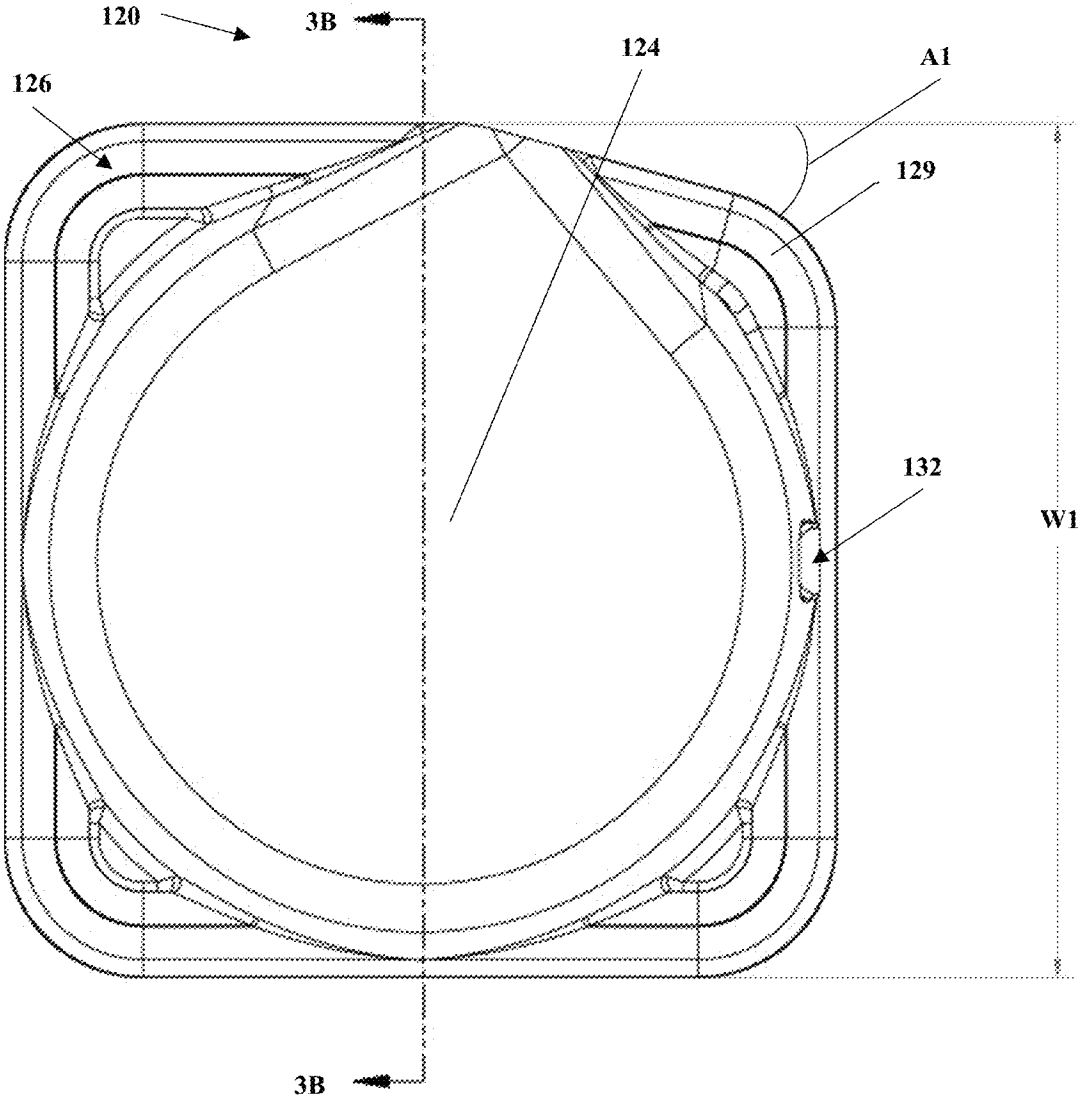
FIG. 3A is a side view of the refillable clamshell container.

As shown in FIGS. 3A-3B, the clamshell container 120 includes a width W1, a thickness T1, and an angle A1. The width W1 may be between about 4.0 inches and about 8.0 inches, alternatively, between about 5.0 inches and about 7.0 inches, alternatively, between about 5.5 inches and about 6.75 inches, alternatively, between about 6.0 inches and about 6.5 inches. The width W1 may be adjusted to the number of packets in the circular configuration. The thickness T1 may between about 1.0 inches and about 4.0 inches, alternatively, between about 1.5 inches and about 3.5 inches, alternatively, between about 2.0 inches and about 3.0 inches, alternatively, about 2.99 inches. The thickness T1 may be adjusted to the thickness of the packets. The angle A1 provides an angled corner 129 for the square border 126. The angle A1 may be between about 5 degrees and about 20 degrees, alternatively, between about 7 degrees and about 18 degrees, alternatively between about 9 degrees and about 15 degrees.

As shown in FIG. 3B, the slit opening 122 includes a height H1 that is sized to allow a packet to traverse the slit opening 122. The height H1 may be between about 2.5 inches and about 4.5 inches, alternatively, between about 3.0 and about 4.0 inches, alternatively, between about 3.2 inches and about 3.8 inches.

Figure 4B:
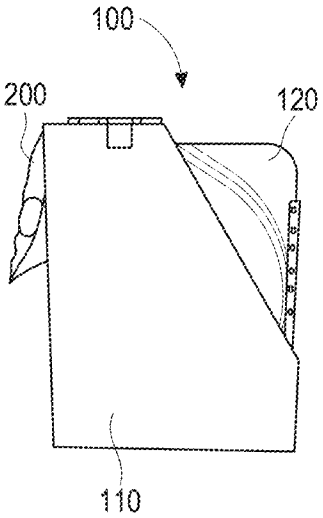
FIG. 4B is a side view of the Pill Packet Dispenser with refillable clamshell container including a packet.
Figure 4A:
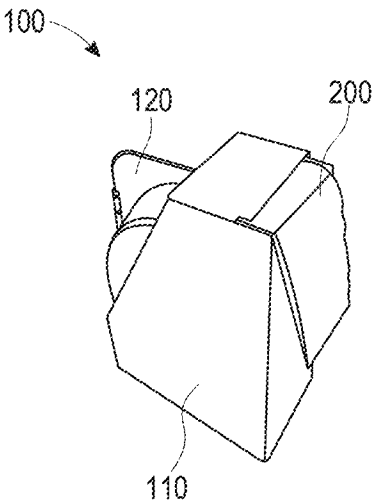
FIG. 4A is a front perspective view of the Pill Packet Dispenser with refillable clamshell container including a packet.

As shown in FIGS. 4A-4B, the Pill Packet Dispenser with a clamshell container system 100 including the packet 200 being dispensed outside the sleeve 130 and the clamshell container 120. As a single packet 200 is pulled by the user, the user is able to tear or break away the packet from the circular configuration of packets 202 disposed within the clamshell container 120. FIG. 4C shows the Pill Packet Dispenser with a clamshell container system 120 in the open position including the circular configuration 202 of packets. The outer sleeve 110 includes a top side 114 that opens to allow the clamshell container 120 to be disposed and sit within the outer sleeve 110. The top side 114 locks down with a tab 116 to secure the clamshell container 120 within the outer sleeve 110.

Figure 5A:
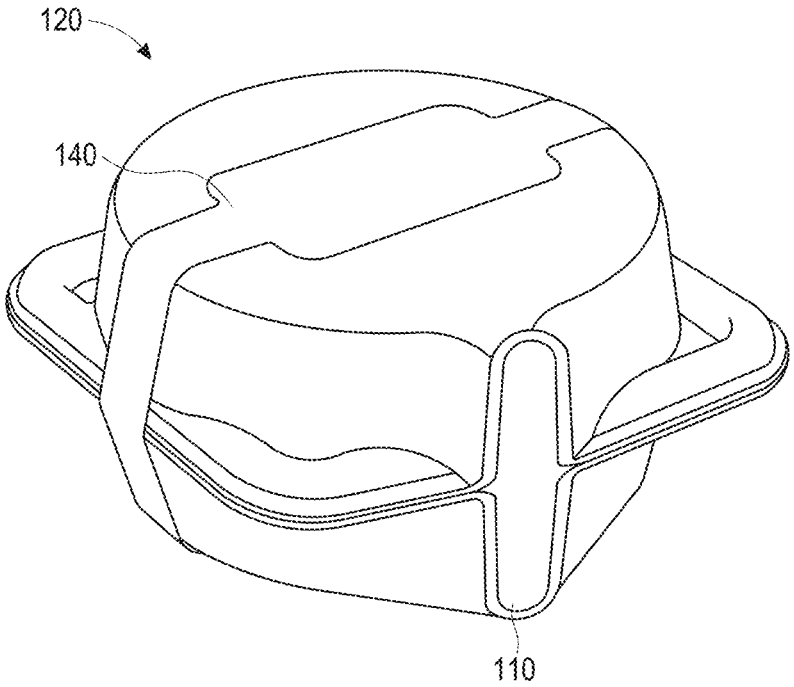
FIG. 5A is a perspective view of the clamshell container including a sticker closure.
Figure 5B:
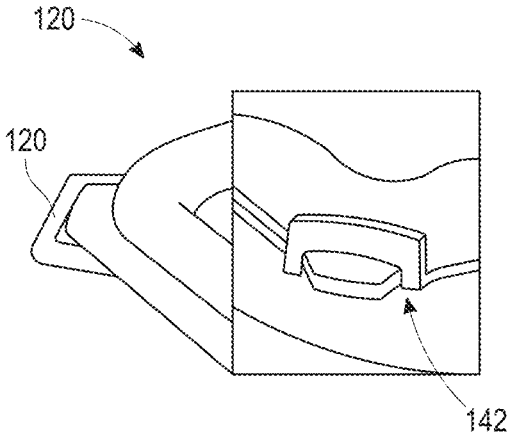
FIG. 5B is an enlarged view of the clamshell container with a card and tab closure.

FIG. 5A is a perspective view of the clamshell container 120 including a sticker closure 140 to secure the clamshell container 120 in the closed position, according to one embodiment. FIG. 5B is an enlarged view of the clamshell container with a card and tab closure 142 to secure the clamshell container 120 in the closed position, according to one embodiment. In one embodiment, the sticker closure 140 or the card and tab closure 142 may replace the locking feature 128 or may be included in additional to the locking feature 128. In one embodiment, the card and tab closure 142 may be included on each corner of the clamshell container or may be included on at least one corner on the clamshell container.

Figure 6A:
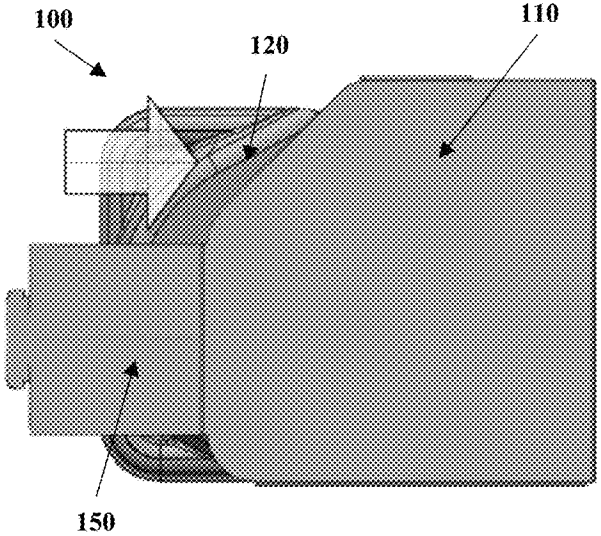
FIG. 6A is a side view of the clamshell container being loaded into the outer sleeve through a back tab portion.
Figure 6B:
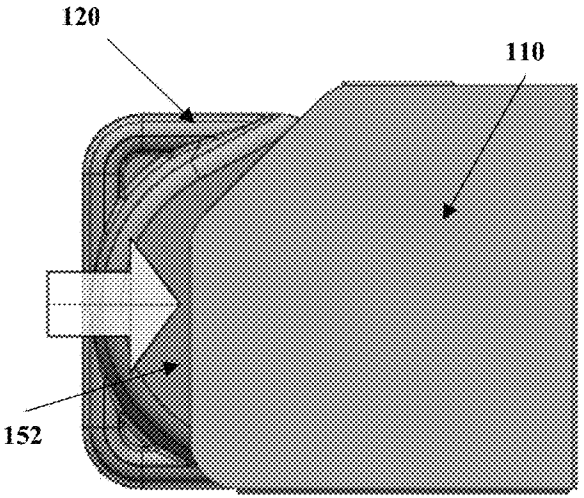
FIG. 6B is a side view of the clamshell container being loaded into the outer sleeve through an open back portion.
Figure 6C:
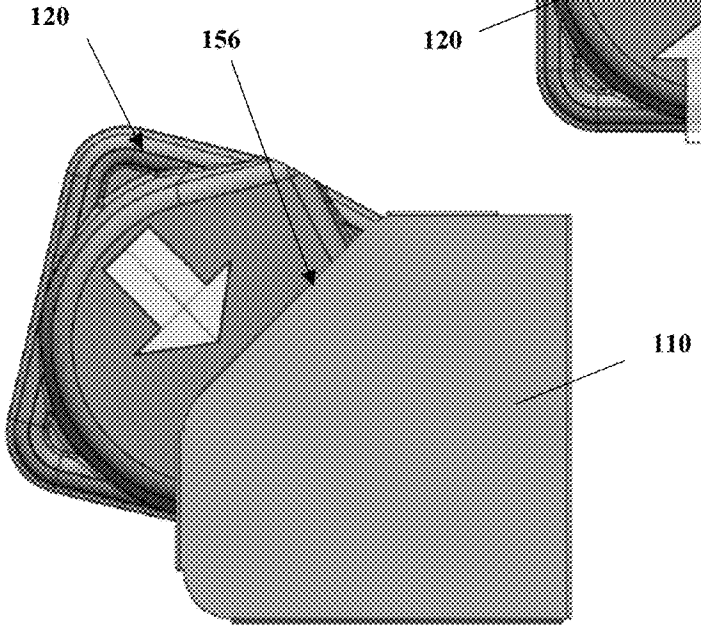
FIG. 6C is a side view of the clamshell container being loaded into the outer sleeve through an open bottom portion.
Figure 6D:
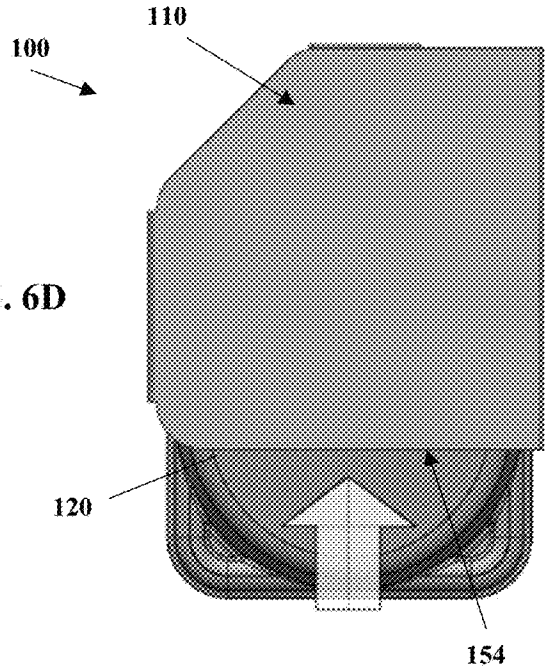
FIG. 6D is a side view of the clamshell container being loaded into the outer sleeve through an angled toe-in portion.

FIG. 6A is a side view of the clamshell container 120 being loaded into the outer sleeve 110 through a back tab portion 150 that opens and closes to secure the clamshell container 120 in the outer sleeve 110. The back tab portion 150 holds the clamshell container 120 securely from all sides. FIG. 6B is a side view of the clamshell container being loaded into the outer sleeve through an open back portion 152, such that the open back portion 152 does not need a tabbed portion to provide for easy loading and unloading the clamshell container and holds clamshell container securely. FIG. 6C is a side view of the clamshell container being loaded into the outer sleeve through an open bottom portion 154, such that the clamshell container does not need a tabbed portion. FIG. 6D is a side view of the clamshell container being loaded into the outer sleeve through an angled toe-in portion 156, such that the clamshell container does not need a tabbed portion.

Figure 7A:
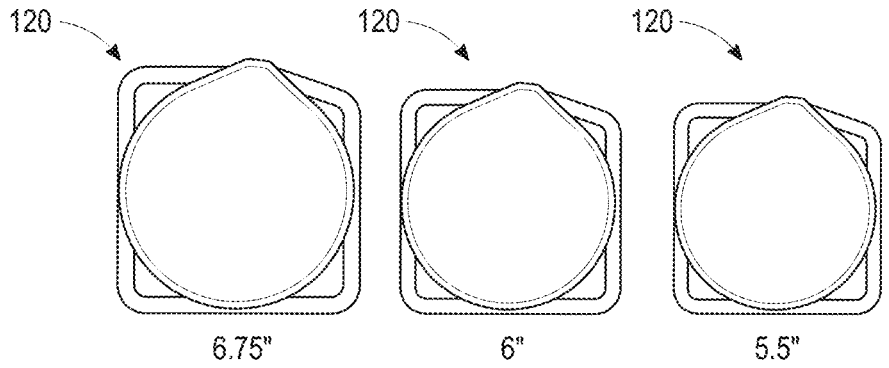
FIG. 7A are side views of the clamshell container in different widths.
Figure 7B:
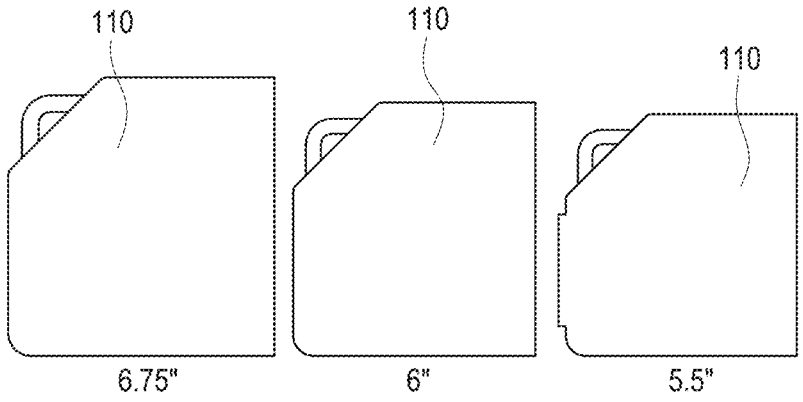
FIG. 7B are side views of the outer sleeve in different widths.

FIG. 7A are side views of the clamshell container in different widths; and FIG. 7B are side views of the outer sleeve in different widths. In each different width, the thickness of the clamshell container and outer sleeve remains the same.

All publications and patent applications mentioned in this specification are herein incorporated by reference to the same extent as if each individual publication or patent application was specifically and individually indicated to be incorporated by reference.

While the invention has been described in connection with various embodiments, it will be understood that the invention is capable of further modifications. This application is intended to cover any variations, uses or adaptations of the invention following, in general, the principles of the invention, and including such departures from the present disclosure as, within the known and customary practice within the art to which the invention pertains.

What is claimed is:

1. A packaging and dispensing system for a roll of packets containing vitamins, supplements or pharmaceuticals, comprising:

an outer sleeve and a clamshell container contained with the outer sleeve;

wherein the clamshell container includes a roll of packets containing vitamins, supplements or pharmaceuticals, and the clamshell container dispenses the roll of packets through a top opening of the outer sleeve;

wherein the clamshell container includes a central circular shell, a square border, and a locking feature, a closed position, and a slit opening on an upper corner of the clamshell container;

wherein the slit opening includes an oval-sized opening P1 to permit the packets to be dispensed through the clamshell container;

wherein the oval-sized opening P1 is adjusted to a size and a width of packets to permit dispensing and the oval sized opening P1 includes a width between about 0.05 and about 0.50 inches.

2. The system of claim 1, wherein the central circular shell allows the packets to be contained in a circular self-wrapping configuration;

the square boarder is sized to be contained with the outer sleeve;

the locking feature allows the clamshell container to be locked in the closed position once the packets are loaded into the clamshell container.

3. The system of claim 2, where the clamshell container includes an open position that allows the packets to be loaded in the central circular shell;

the central circular shell includes a volume V1 sufficient to contain the circular self-wrapping packet;

the locking feature includes a tabbed portion and a tab opening that operate to lock the clamshell container once in the closed position.

4. The system of claim 3, wherein the square boarder includes four engagement portions that abut each other once the clamshell container is in the closed position.

5. The system of claim 4, wherein the clamshell container includes a width W1, a thickness T1, and an angle A1;

the width W1 is between about 4.0 inches and about 8.0 inches; and the thickness T1 is between about 1.0 inches and about 4.0 inches;

the angle A1 is between about 5 degrees and about 20 degrees.

6. The system of claim 5, wherein slit opening includes a height H1 that is sized to allow a packet to traverse the slit opening;

the height H1 is between about 2.5 inches and about 4.5 inches.

7. The system of claim 6, wherein the outer sleeve includes a top side that opens to allow the clamshell container to be disposed and sit within the outer sleeve; and the top side locks down with a tab to secure the clamshell container within the outer sleeve.

* * * * *